United States Patent [19]

Granet

[11] 4,177,018

[45] Dec. 4, 1979

[54] APPARATUS FOR REGULATING THE PASSAGE AND FLOW-RATE OF A LIQUID

[75] Inventor: Jacques R. Granet, Laval, France

[73] Assignee: Le Material Telephonique, Boulogne-Billancourt, France

[21] Appl. No.: 866,841

[22] Filed: Jan. 4, 1978

[30] Foreign Application Priority Data

Jan. 4, 1977 [FR] France ..... 77 00058

[51] Int. Cl.[2] ..... F04B 23/04; F04B 41/06

[52] U.S. Cl. ..... 417/338; 417/426; 417/428

[58] Field of Search ..... 417/338, 426, 427, 428; 237/63; 137/606

[56] References Cited

U.S. PATENT DOCUMENTS 2,810,345 10/1957 Englesson ..... 417/338

FOREIGN PATENT DOCUMENTS 2102351 7/1971 Fed. Rep. of Germany ..... 417/426
2459238 6/1976 Fed. Rep. of Germany ..... 417/427
2105733 4/1972 France .
1435159 5/1976 United Kingdom ..... 417/427

*Primary Examiner*—Richard E. Gluck
*Attorney, Agent, or Firm*—Roland Plottel

[57] ABSTRACT

A symmetrical, twin centrifugal pump includes a pair of valves mounted about a common shaft. The valves are capable of independent operation thus allowing either or both of the pump elements to operate. A key is also mounted to the shaft to allow overall regulation of the pump by selectively impeding the flow of liquid from the pump inlet to pump outlet.

2 Claims, 2 Drawing Figures

APPARATUS FOR REGULATING THE PASSAGE AND FLOW-RATE OF A LIQUID

BACKGROUND OF THE INVENTION (A) Field of the Invention

The present invention, which relates generally to liquid pumping units comprising multiple centrifugal pump elements incorporated in a common body, is particularly concerned with apparatus for controlling the passage of the liquid between several channels inside the pump body and with the adjustment of the flow-rate produced by these pumping units. The present invention is also concerned with the mounting of these passage and flow-rate control devices in a pumping unit, such as a central-heating booster pump.

(B) Discussion of the Prior Art

In order to reduce the cost of industrial or domestic heating installations, it is advantageous to fabricate pumping units which comprise several discrete pump elements combined in a common pump body. Advantageously, the pump elements are mass-produced and they need not have the same shape and operating characteristics. Manufacturers currently produce modules which group two, three or even more similar pump elements in modular form. The grouping of two identical pump elements in a common pump body is perhaps the most common configuration for such pumping units which are known as twin pumps. When used for industrial or domestic central heating, they are commonly known as twin booster pumps.

The twin pump or booster pump is advantageous since it assures high reliability for the heating system in which it is installed. Consider, however, an installation using a single pump which has failed. Replacing the failed pump by a new pump is in itself an easy operation, but requires that the heat be turned off and the pipes drained. These factors seriously disturb operation, especially during cold spells. The use of a twin pump, however, protects the installation from such problems. The centrifugal pump elements are typically identical. Their operating characteristics, and in particular the power of each, are selected so as to satisfy the requirements of the installation. The twin pump is intended for alternate operation, i.e. each pump element is operated alternately. In the event of a failure in one of the elements, the other automatically takes over.

In general, in order to avoid unequal wear of the pump elements, both elements are operated on a 50% duty cycle. The work loads are thus balanced. Naturally, if one element fails, the installation is not disturbed in any way. Normal operation can quickly be re-established by merely replacing the defective pump element with a new element, without draining the plumbing. Finally, the use of a twin pump considerably reduces the risk of failure, since it is extremely rare for both elements to fail simultaneously. This conventional solution is today used frequently in most new installations.

For the manufacturer, the production of these pumping units raises two kinds of problem. First, it is necessary to provide a pump element which alternates the flow in the channels feeding the pumps in a virtually automatic manner. Second, it is advantageous to provide a pump component to vary the flow-rate of either pump in order to adjust the flow-rate to the installation served. The flow-rate is controlled by an adjustable shutter, known as a variator, located in a duct known as the discharge duct between the outlet and inlet. At first blush, this conventional arrangement would seem to call for as many variators, on as many discharge ducts, as there are pump elements.

In order to satisfy the first of the above requirements, the manufacturer typically incorporates valve systems in the common pump body to automatically control the alternated passage of liquid to or from either element.

The French Pat. No. 2,105,733 filed by the present applicant, discloses an adjustable-flow, multiple-booster pump, including a twin booster in which the element which controls the passage of the liquid in the outlet is a spring-loaded valve 22. As shown in FIG. 4 of that patent which is hereby incorporated by reference, the valve automatically controls the outlet 23' in volute 18' of the left pump element when the right volute 18 delivers liquid to the common outlet chamber to the general orifice 15. This valve, which is freely mounted on a shaft perpendicular to the plane of the figure, is held in position by a return spring designed to yield to the liquid pressure on the surface opposite that on which the return spring is mounted. On the inlet, the supply is controlled by a four-way valve, as shown in FIG. 1.

In order to meet the second of the above requirements, the above-mentioned patent describes, for regulating the twin booster output, a single variator whose control knob 9 operates simultaneously on the position of two planetary parts, each installed in a manner providing communication between the inlet duct 20 and outlet duct 21 for the corresponding pump element. The variator described simultaneously provides effective regulation of the flow of both pump elements by means of a single control and, therefore, regulation of the twin booster pump output.

The saving in space which is achieved as a result of replacing at least two complete pumps connected in cascade by a pumping unit containing at least two pump elements incorporated in a common body is nervertheless still limited, since it is necessary to adapt to the common body on the outlet side, according to the invention mentioned above, at least one system of valves and at least a control mechanism with complex gears on the discharge ducts of the pump elements.

SUMMARY OF THE INVENTION

In order to save further space and to simplify the distribution and flow rate controls in the common body of a twin centrifugal pumping unit, the present invention proposes a device characterized by the fact that it possesses at least one valve which can rotate about a shaft and a rotating key of the spigot tap type whose shaft is coincident with that of the valve, and by the fact that the valve and key, both mounted on a common shaft, each act on two passages accessible to the circulating liquid for shutting off or adjusting the degree of communication between at least two circulating liquid chambers inside the pump body.

Other features of the invention will become evident from the detailed description below when taken with the drawing. It should be understood that the description and the drawings are by way of example only and in no way limit the scope of the invention.

DETAILED DESCRIPTION OF THE INVENTION

Figure 1:
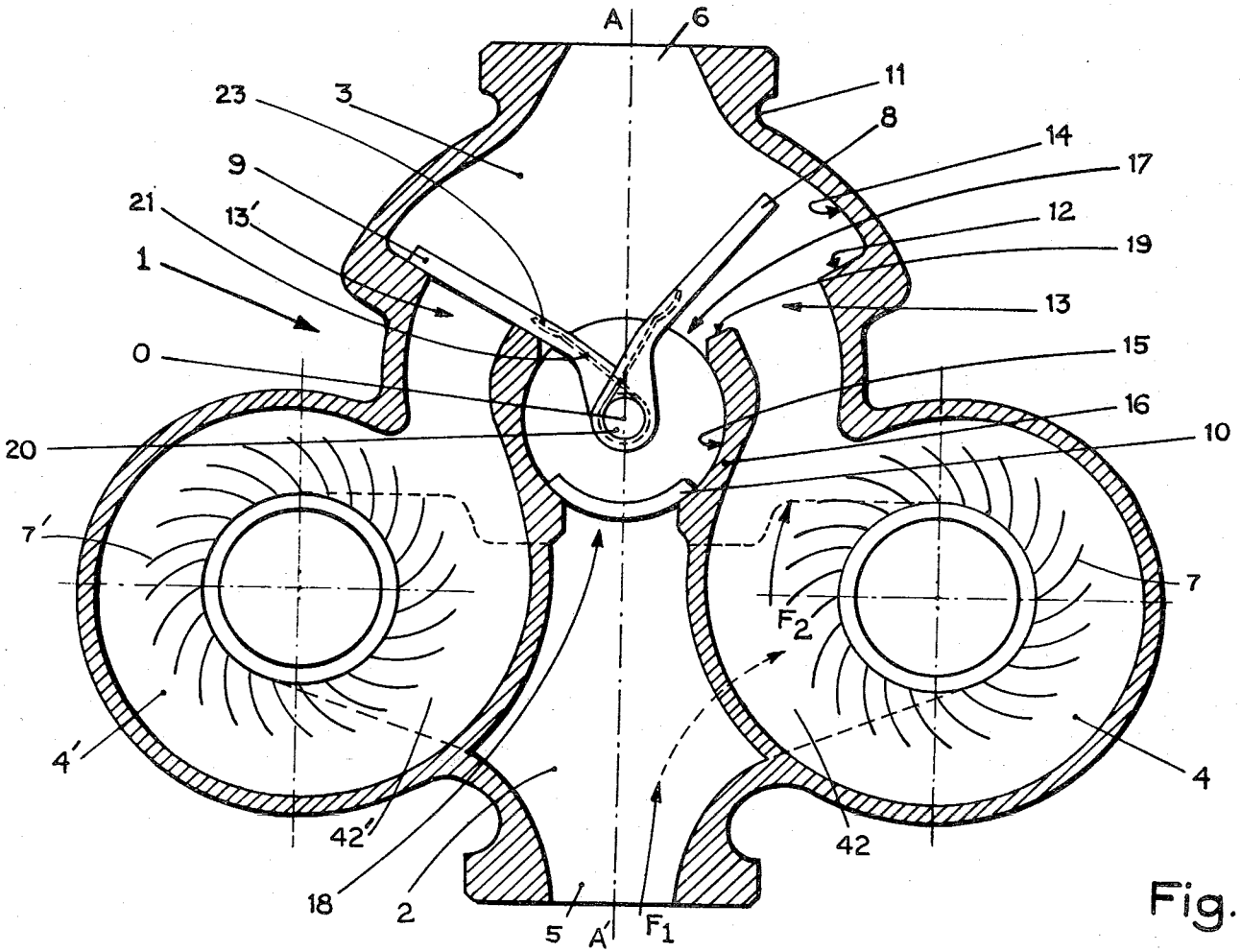
FIG. 1 illustrates a pump according to the invention and comprises a vertical section in a plane parallel to the front surface of the twin pump body.

FIG. 1 shows the structure of an illustrative pump body 1 according to the invention. The section shown is parallel to the front surface of the pump in a plane containing centre-line A'A which, of course, is common to the inlet and outlet orifices. The inlet chamber 2 is at the bottom. The outlet chamber 3 is at the top. The general structure is symmetrical with respect to centre-line AA' through the pump inlet 5 and outlet 6. Each of these orifices is common to both elements of the twin pump which are located symmetrically, the section showing both the right volute 4 and left volute 4' and their respective inlets 42 and 42'. Fluid flows in the direction of arrows F1 and F2 shown in the right volute 4 and is driven by impellers 7 and 7'. The compact shape of pump 1 is apparent, in particular, the increasing width of the outlet chamber 3 above the throat 11 of the top orifice 6. The internal wall of the pump body possesses a part which protrudes inwardly close to outlets 13 and 13' of volutes 4 and 4' respectively. This protruding part is terminated at the top by an edge 12 constituting a half-flat, practically perpendicular to the top internal wall 14. It is terminated at the bottom by the volute. By forming the outlets 13 and 13' towards the outlet orifice, the right and left volutes 4 and 4' constitute a body 16 whose internal wall 15 has a circular section contour centred about 0 and possessing a top orifice 17 and a bottom orifice 18.

According to the invention, provision is made for mounting a cylindrical control shaft 20 centred at 0 and coaxial with the body 16. The two valves 8 and 9 are mounted on this shaft. These valves are similar, and are slightly curved, as shown by the vertical section in FIG. 1. The curvature ensures that the underside of each valve correctly matches the edge of each volute outlet, such as edges 19 and 12, against which they bear when in the closed position.

Figure 2:
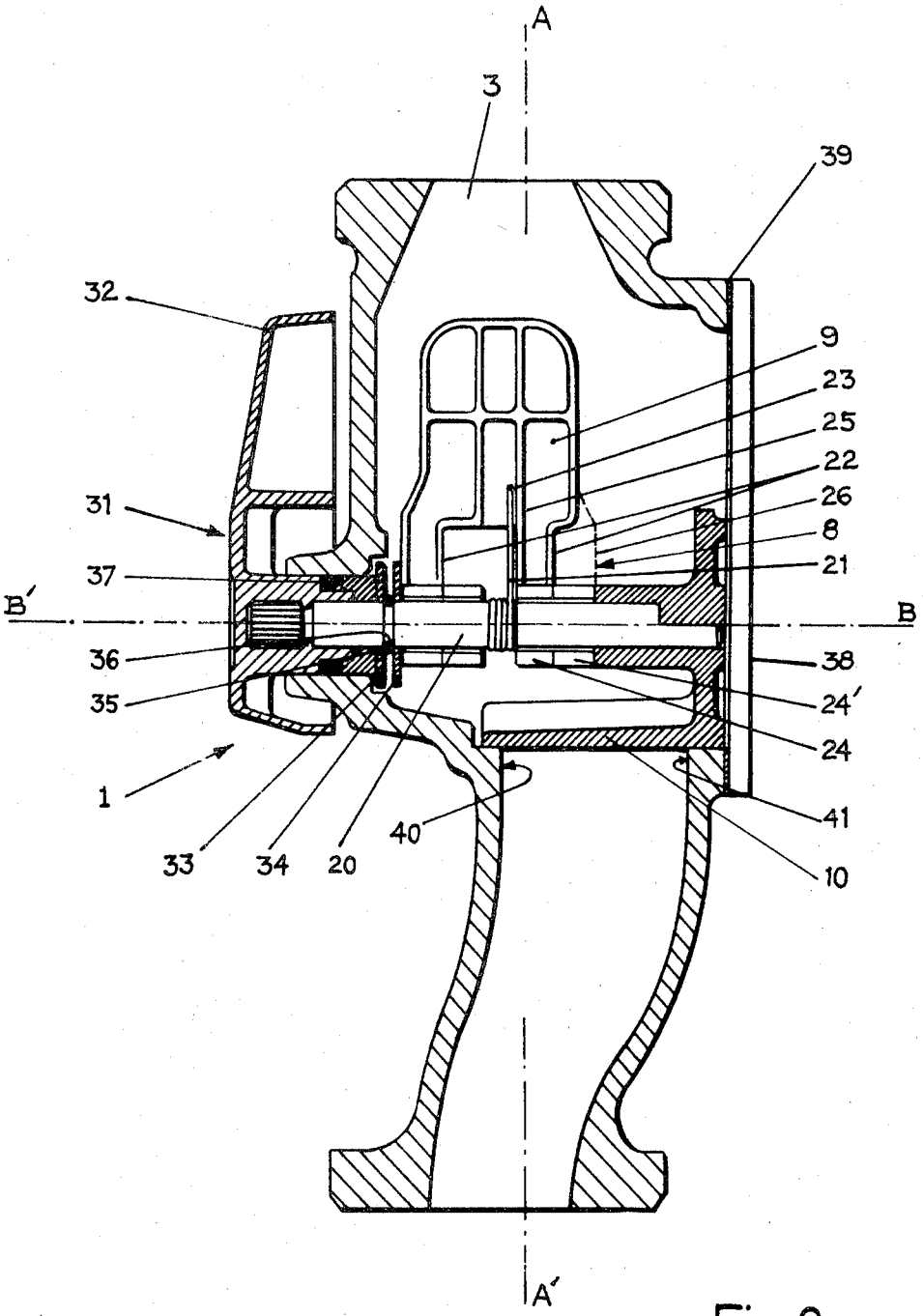
FIG. 2 illustrates the device shown in FIG. 1 by a vertical section in a diametrical plane perpendicular to the front surface of the twin pump.

FIG. 2 is a vertical section perpendicular to the section of FIG. 1, and shows a side view which clarifies the shape of one of the valves, valve 9. The shape of this valve matches that of the orifice which comprises the outlet of volute 4' in outlet chamber 3. Naturally, the surface of the valve exceeds that of the orifice to be shut off, thus ensuring a proper seal. As illustrated in both FIGS. 1 and 2, the top surface of each valve is held down by a return spring, such as spring 21, whose coiled part is placed over shaft 20. The valves rotate freely about shaft 20. As seen in FIG. 2, each valve is carried by a pair of arms 22 mounted without friction on shaft 20 by means of two sleeves, such as sleeve 24. The free end 23 of spring 21 bears on the front surface of valve 9. It can slide on this surface, guided by the rib 25 on the valve surface. The free ends, such as end 23, end naturally in the same manner as the corresponding free part of the spring of valve 8, and both are bowed, as may be seen in the section drawing of FIG. 1. The arms 26 and sleeves 24' of valve 8, shown by dashed lines in FIG. 2, alternate with arms 22 and sleeves 24 of valve 9. When assembled, the arms are slid onto shaft 20 such that they can rotate freely without friction.

In addition, a key 10 is mounted in the body 16 and is locked to the control shaft 20 with which it can rotate about the axis of rotation BB' perpendicular at point 0 to axis A'A (see FIG. 1). The key is locked to shaft 20 by means of a rigid mechanical attachment during assembly. This attachment can be obtained by pinning or any other method. In addition, the common shaft 20 is also locked to control knob 31 whose handle 32 is external to pump body 1. This attachment can be provided by moulding the control shaft 20 into the knob 31 when the latter, as illustrated in the figures, is made of mouldable plastic material. The assembly of the knob and key locked to the control shaft as illustrated in FIG. 2 includes two washers 33 and 34 placed on shaft 20 either side of a split lock-ring 35 inserted in grooves 36 of shaft 20, holding the washers in position. Finally, a perfect seal to the right of control knob 31 is provided on the front surface of the pump by a O-ring 37.

The pump body is open to the rear. After installation, the opening is blanked by a plate 38 assembled on a flat gasket 39.

Once fully assembled, the pump is completely watertight.

In operation, the pump performs two functions; the first consists of automatically controlling the volute outlets to the outlet chamber. For example, if the right-hand pump is operating, the circulating liquid passes through volute 4 in the direction of arrow $F_2$ shown in FIG. 1. The pressure of the liquid at outlet 13 pushes against the underside of valve 8. The force of the return spring of this valve is designed to be slightly less than that produced by the pressure of the fluid. Valve 8, pushed by the greater force produced by the fluid, rotates towards the centre-line A'A, thereby opening the passage to the outlet chamber 3. This situation is illustrated in FIG. 1, where outlet 13 of volute 4 is open, while outlet 13' of volute 4' is held closed by the return spring 21 against which no pressure operates, since the left-hand pump is not operating. This prevents the circulating liquid from flowing back through the left-hand pump which is not operating.

The second function permits the user to adjust a pump flow irrespective of which pump is operating. It is seen that key 10 can occupy any possible position with respect to orifice 18 which is terminated by the internal edges 40 and 41 of the inlet duct. When the key leaves this orifice open, communication is provided between the inlet chamber 2 and outlet chamber 3. If the key leaves the orifice partially open, partial communication is established between the inlet chamber 2 and outlet chamber 3. Finally, this communication can be completely cut off between the inlet and outlet chambers when the key is in the position shown in FIG. 1, completely closing orifice 18. Control knob 31 thus provides full flow adjustment, regardless of which pump is operating.

It is apparent that the location of the variator device is such that the adjustment is identical and simultaneous for both pump elements because of its symmetry. This configuration also has the advantage of simplifying the construction of the twin pump body, since formerly the use of a flow variator necessitated the provision of as many discharge ducts as pump elements. The use of the instant invention avoids the need to provide any dischrage duct, thereby simplifying constuction.

Finally, placing the valves, key and variator control knob on a single, common shaft results in a one-piece assembly for two functions and considerably simplifies the twin pump body.

Such simplification results in appreciable cost savings and an advantageous decrease of physical dimensions.

It should be mentioned that a twin pump in accordance with that described above, can also operate correctly, though perhaps less advantageously, when both pumps are running. In this case, valves 8 and 9 are half-open with no particular disadvantage, since the circulating liquid cannot flow back through either one of the pump elements. Simultaneous operation is thus possible as in the case of prior art twin pumps, but this mode of operation and in of itself offers little advantage which would lead to its wider use. The real advantage of multiple pumps, and in particular twin pumps, is that of alternate operation.

Although the principles of the present invention are described above in relation with specific practical examples, it should be clearly understood that the said description is given as an example only and does not limit the scope of the invention.

I claim:

1. A liquid pumping unit comprising two centrifugal pumps disposed in a common casing (1) providing an inlet chamber (2) and an outlet chamber (3) for the liquid, each pump comprising an impeller mounted in a volute (4, 4') and adapted to be driven by a motor, each volute having an inlet (42, 42') and an outlet (13, 13') communicating with the inlet and outlet chambers (5, 6) respectively, a two flap type check valve (8, 9) is rotatably mounted on a common shaft (20), each flap being able to close one outlet of a volute (13, 13'), the shaft (20) has a regulating valve (10) secured thereto and controlled thereby, the regulating valve being mounted in a passage (17–18) connecting said outlet and inlet, to block or adjustably permit the flow of fluid in said passage, and thus can by-pass the fluid from the outlet(s) to the inlet(s) of the volute(s) when the flap(s) are open.

2. A liquid pumping unit according to claim 1 wherein the shaft extends without the common casing and comprising a control knob moulded on the shaft.

* * * * *